United States Patent [19]

Dayen et al.

[11] Patent Number: 4,826,064

[45] Date of Patent: May 2, 1989

[54] END PIVOT WEBGUIDE

[75] Inventors: Leonid Dayen, Plymouth; Charles D. Raines, Blaine, both of Minn.

[73] Assignee: Horton Manufacturing Co., Inc., Minneapolis, Minn.

[21] Appl. No.: 155,122

[22] Filed: Feb. 11, 1988

[51] Int. Cl.[4] ..... B65H 23/038

[52] U.S. Cl. ..... 226/21

[58] Field of Search ..... 226/18, 21–27, 226/180, 15, 95

[56] References Cited

U.S. PATENT DOCUMENTS

| | | | |
|---|---|---|---|
| 3,368,665 | 2/1968 | Jinkins | 226/23 X |
| 3,942,696 | 3/1976 | Pira et al. | 226/21 |
| 4,204,619 | 5/1980 | Damour | 226/21 |

FOREIGN PATENT DOCUMENTS

| | | | |
|---|---|---|---|
| 2040294 | 2/1972 | Fed. Rep. of Germany | 226/21 |

*Primary Examiner*—Donald Watkins

*Attorney, Agent, or Firm*—Peterson, Wicks, Nemer & Kamrath

[57] ABSTRACT

An end pivot webguide which may be economically fabricated from stock material and eliminating many cast components is disclosed including pivot arms formed from bar stock and roller frames formed from angle stock. The pivot arms are formed by drilling passages including annular shoulders for receiving radial ball bearings in the bar stock for rotatably mounting first and second pivot pins. The use of radial ball bearings allows the pivot pins to accept thrust forces in an axial direction such that the webguide of the present invention utilizes four bearings of identical type rater than six bearings of three different types as in prior webguides. The pivot arm is symetrical such that one of the pivot pins may be nonrotatably secured to the webguide base and the other pivot pin may be nonrotatably secured to the roller frame. Bearings in the guide rolls rotatably mount the guide rolls on screws removably and nonrotatably secured to the roller frames. Different sized guide rolls may then be utilized by simply selecting corresponding sized angle stock forming the roller frames.

20 Claims, 1 Drawing Sheet

END PIVOT WEBGUIDE

BACKGROUND

The present invention relates generally to webguides for guiding a web of material such as paper or the like, particularly, to end pivot webguides, and specifically, to end pivot webguides including a reduced number of components, many of which are fabricated from stock material to eliminate the requirement for casting.

Prior end pivot webguides are disadvantageous in several respects resulting from the use of cast components and many different components. First, the use of castings greatly increases capital expenditures necessary for fabrication. These capital expenditures are further multiplied because different sized castings are required for different sizes of guide rolls utilized. Additionally, castings are relatively heavy and expensive to ship especially for long distances. Also, prior end pivot webguides were relatively expensive to assemble and inventory due to the large number of different components necessary.

Thus, a need has arisen for an improved end pivot webguide which overcomes the many deficiencies and disadvantages of prior end pivot webguides.

SUMMARY

The present invention solves these deficiencies and disadvantages of prior end pivot webguides and solves this need and other problems in end pivot webguides by providing, in the preferred form, pivot arms including first and second pivot pins pivotally mounted in the body of the pivot arm in a manner to accept thrust forces in the axial direction of the pivot pins. The free end of the first pivot pin is removably and nonrotatably secured to the base and the free end of the second pivot pin is removably and nonrotatably secured to the roller frame, which in the most preferred form are formed from angle stock. The guide rolls are in turn rotatably mounted to the roller frames by members which are removably and nonrotatably secured to the roller frames. The web of material such as paper or the like may then be guided by the guide rolls by pivoting one of the pivot arms relative to the base about the first pivot pin.

It is thus an object of the present invention to provide a novel end pivot webguide.

It is further an object of the present invention to provide such a novel end pivot webguide which has reduced start-up costs.

It is further an object of the present invention to provide such a novel end pivot webguide which may eliminate cast components.

It is further an object of the present invention to provide such a novel end pivot webguide having reduced number of types of components.

It is further an object of the present invention to provide such a novel end pivot webguide which is easier and more economical to fabricate.

It is further an object of the present invention to provide such a novel end pivot webguide which utilizes components fabricated from stock material.

It is further an object of the present invention to provide such a novel end pivot webguide having symmetrical pivot arms.

It is further an object of the present invention to provide such a novel end pivot webguide including several types of components of identical construction.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
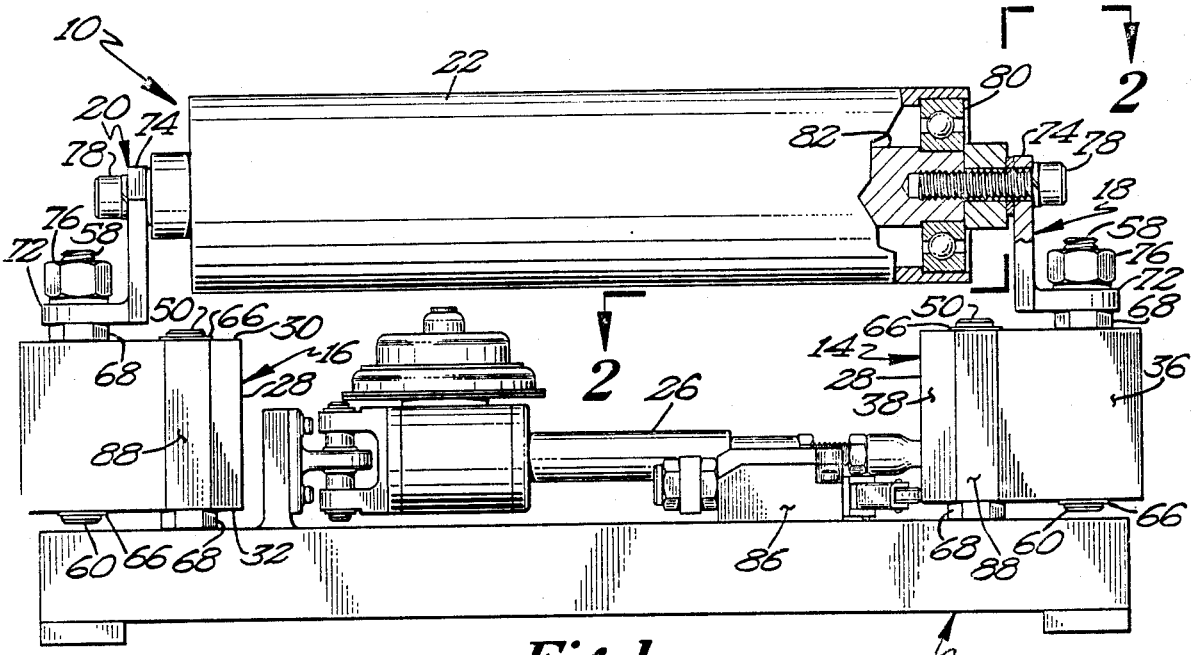
FIG. 1 shows a front plan view of an end pivot webguide according to the preferred teachings of the present invention.
Figure 2:
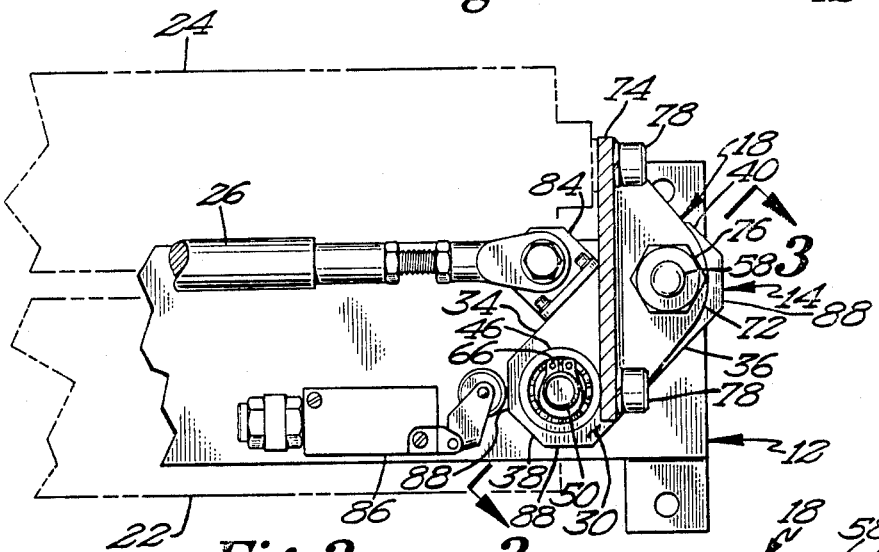
FIG. 2 shows a partial, sectional view of the end pivot webguide of FIG. 1 according to section line 2—2 of FIG. 1.
Figure 3:
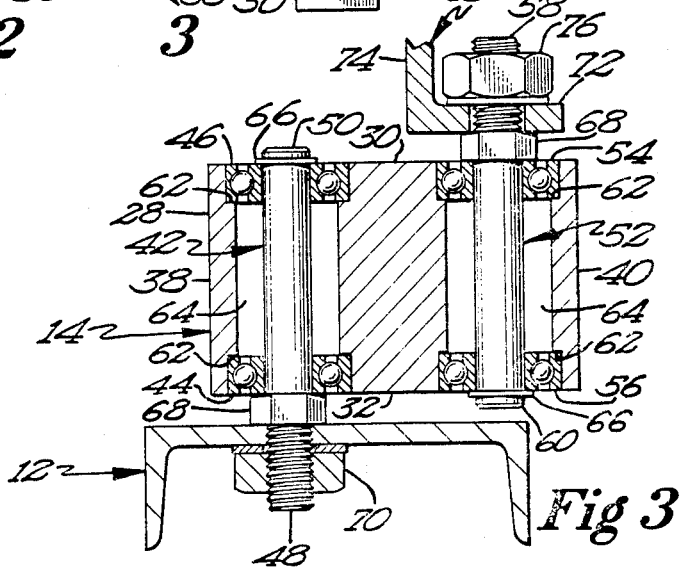
FIG. 3 shows a sectional view of the end pivot webguide of FIG. 1 according to section line 3—3 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "end", "side", "edge", "first", "second", "inside", "outside", "inner", "outer", and similar terms are used herein, it should be understood that these terms have reference only to the structure shown in the drawings as it would appear to a person viewing the drawings and are utilized only to facilitate describing the invention.

DESCRIPTION

An end pivot webguide for guiding a web of material such as paper or the like is shown in the drawings and is generally designated 10. Webguide 10 generally includes a base 12, first and second pivot arms 14 and 16, first and second roller frames 18 and 20, first and second guide rolls 22 and 24, and an actuator 26.

Pivot arms 14 and 16 in the most preferred form include a generally solid parallelepiped body 28 having a top 30, a bottom 32, a first side 34, a second side 36, a first end 38, and a second end 40. A first pivot pin 42 is pivotally mounted in body 28 adjacent first end 38 and intermediate sides 34 and 36 by first and second radial ball bearings 44 and 46, with the free end 48 of pin 42 being threaded and extending beyond bottom 32 of body 28. A second pivot pin 52 is pivotally mounted in body 28 adjacent second end 40 and intermediate sides 34 and 36 by first and second radial ball bearings 54 and 56, with the free end 58 of pin 52 being threaded and extending beyond top 30 of body 28. Pins 42 and 52 are spaced equidistant from ends 38 and 40, respectively. Pins 42 and 52 and bearings 44, 46, 54, and 56 are axially retained in body 28 by having the outer races of bearings 44, 46, 54, and 56 abut with annular shoulders 62 formed in passages 64 of body 28 and by having the inner races of bearings 46 and 56 abut with a snap ring 66 received on opposite ends 50 and 60 of pins 42 and 52 and the inner races of bearings 44 and 54 abut with a nut 68 integrally formed on pins 42 and 52 adjacent ends 48 and 58. Bearings 44, 46, 54, and 56 are of identical construction and accept thrust forces in the axial direction of pivot pins 42 and 52. Similarly, pins 42 and 52 and snap rings 66 are also of identical construction. It can then be appreciated that pivot arms 14 and 16 are symmetrical about their center.

Free ends 48 of pivot pins 42 of pivot arms 14 and 16 are removably and nonrotatably secured to base 12 in the most preferred embodiment by a nut and washer 70 which with nut 68 sandwiches base 12 therebetween.

Roller frames 18 and 20 in the most preferred form are standard angle stock and specifically includes a first flange 72 and a second flange 74 connected generally perpendicularly to each other by their end edges. Free ends 58 of pivot pins 52 of pivot arms 14 and 16 are removably and nonrotatably secured to frames 18 and 20 in the most preferred embodiment by a nut and washer 76 which with nut 68 sandwiches flange 72 of frames 18 and 20 therebetween.

Guide rolls 22 and 24 are rotatably mounted to and between roller frames 18 and 20 by screws 78 removably and nonrotatably secured to flange 74 of roller frames 18 and 20 which carry bearings 80 received in guide rolls 22 and 24. It can be appreciated that guide rolls 22 and 24 and their rotatable mounting on screws 78 can take several forms such as including a core 82 upon which screws 78 are threadably received and upon which bearings 80 are mounted as shown.

Actuator 26 in the preferred form is pivotally attached to pivot arm 14 such as by an L bracket 84 secured to side 34 of body 28 for pivoting pivot arm 14 relative to base 12 about pivot pin 42. Actuator 26 can take several forms such as electrically operated as shown, hydraulically operated, or the like. In the most preferred form, limit switches 86 are provided for actuator 26 and operatively engage a truncated corner 88 formed between sides 34 and 36 and ends 38 and 40 of body 28 of pivot arm 14.

Now that the construction of webguide 10 according to the preferred teachings of the present invention has been explained, the advantages thereof over the prior art can be set forth and appreciated. Prior end pivot webguides included roller blocks having the bearings for rotationally mounting the guide rolls and the pivot arms relative thereto. Due to the restricted space in the roller block between the bearings for the guide rolls, it was necessary to utilize needle roller bearings inside of the roller blocks and thrust bearings outside of the roller block as the needle roller bearings are unable to accept thrust forces in the axial direction of the pivot pin. Thus, six bearings of three different types were utilized in prior end pivot webguides to pivotally mount the roller blocks to the pivot arms.

Webguide 10 according to the teachings of the present invention gains several advantages over prior end pivot webguides. Specifically, pivot arms 14 and 16 are pivotally mounted to and between base 12 and roller frames 18 and 20 utilizing four bearings of the identical type which is two less bearings and two fewer types than prior end pivot webguides. This feature reduces the cost of components, assembly, and inventory as fewer parts are necessary to assemble and keep on inventory. Similarly, pivot pins 42 and 52 are of an identical construction rather than unique as in prior end pivot webguides which further reduces the cost of inventory. Likewise, the symmetrical nature of pivot arms 14 and 16 allow assembly of pivot arms 14 and 16 themselves and their assembly to base 12 and roller frames 18 and 20 to be more easily and economically performed with fewer assembly errors.

Further, the cost of roller frames 18 and 20 is less than roller blocks utilized in prior end pivot webguides. Specifically, prior roller blocks were cast and thus are expensive to fabricate. Additionally, it can be appreciated that it is necessary to have different size roller blocks for different diameter guide rolls, necessitating multiple castings. As roller frames 18 and 20 according to the teachings of the present invention do not include bearings, roller frames 18 and 20 may be formed from angle stock and are not required to be cast with its attendant costs. It can then be appreciated that capital costs are reduced as casting costs are reduced for webguide 10 according to the teachings of the present invention utilizing roller frames 18 and 20. Similarly, webguide 10 according to the teachings of the present invention is much more versatile in regard to utilizing guide rolls 22 and 24 of different diameters as it is only necessary to utilize a corresponding sized angle stock and does not require separate casts for each size of guide rolls as in prior end pivot webguides. Additionally, it can be appreciated that webguide 10 according to the teachings of the present invention is further advantageous in regard to shipping to remote locations as it is not necessary to ship heavy cast components as was required in prior webguides due to the high cost of the molds but rather these components can be made on location from readily available stock material.

Likewise, body 28 according to the teachings of the present invention is less expensive to fabricate than pivot arms of prior end pivot webguides. Specifically, body 28 can be cut from bar stock with passages 64 and shoulders 62 being drilled according to the teachings of the present invention. Thus, casting and the start-up costs associated therewith may be eliminated utilizing body 28 of the preferred teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. End pivot webguide for guiding a web of material such as paper or the like comprising, in combination: a base; a first pivot arm; a second pivot arm; a first roller frame; a second roller frame; at least a first guide roll having a first end and a second end, with the pivot arms comprising, in combination: a first pivot pin having a free end; a second pivot pin having a free end; a body having a top and a bottom; means for pivotally mounting the first pivot pin in the body with the free end of the first pivot pin extending beyond the bottom of the body and for allowing the first pivot pin to accept a thrust force in the axial direction of the first pivot pin; means for pivotally mounting the second pivot pin in the body with the free end of the second pivot pin extending beyond the top of the body and for allowing the second pivot pin to accept a thrust force in the axial direction of the second pivot pin, with the free ends of the first pivot pin of the first and second pivot arms being removably and nonrotatably secured to the base, with the free end of the second pivot pin of the first pivot arm being removably and nonrotatably secured to the first roller frame, with the free end of the second pivot pin of the second pivot arm being removably and nonrotatably secured to the second roller frame; means removably and nonrotatably secured to the first roller frame for rotatably mounting the first end of the guide roll to the first roller frame; means removably and nonrotatably secured to the second roller frame for rotatably mounting the second end of the guide roll to the second roller frame; and means for pivoting the first pivot arm relative to the base about the first pivot pin.

2. The end pivot webguide of claim 1 wherein the first and second pivot pins are of identical construction and the means for pivotally mounting the first and second pivot pins in the body are of identical construction.

3. The end pivot webguide of claim 2 wherein the first and second pivot arms are symmetrical.

4. The end pivot webguide of claim 2 wherein the means for pivotally mounting the first and second pivot pins in the body comprises, in combination: radial ball bearings having outer races mounting in the body and inner races mounted on the pivot pins.

5. The end pivot webguide of claim 4 further comprising, in combination: first and second passages formed in the body, with the passages including annular shoulders formed adjacent the top and the bottom of the body for abutting with the outer races of the radial ball bearings for preventing axial movement of the outer races of the radial ball bearings inwardly of the passage.

6. The end pivot webguide of claim 5 further comprising, in combination: snap rings received on the ends of the first and second pivot pins opposite to the free ends for abutting with the inner races of the radial ball bearings, with the free ends of the pivot pins being threaded; and first nuts integrally formed adjacent the free ends of the pivot pins for abutting with the inner races of the radial ball bearings, with the snap rings and first nuts sandwiching the radial ball bearings into the passages of the body.

7. The end pivot webguide of claim 6 wherein the free ends of the first and second pivot pins are removably and nonrotatably mounted by second nuts threadably received on the free ends of the pivot pins for sandwiching the base and the roller frames on the pivot pins with the first nuts.

8. The end pivot webguide of claim 5 wherein the pivot arms are cut from bar stock, with the passages and annular shoulders being drilled in the bar stock.

9. The end pivot webguide of claim 8 wherein the body includes a first side; wherein the pivoting means comprises, in combination: an L bracket secured to the side of the body of the first pivot arm; and an actuator pivotally mounted to the L bracket.

10. The end pivot webguide of claim 9 wherein the body further includes a second side, a first end, and a second end, with the body having a generally solid parallelepiped shape.

11. The end pivot webguide of claim 10 wherein the corners between the sides and ends of the body are truncated; and wherein the pivoting means further comprises, in combination: a limit switch for stopping the actuator, with the limit switch engaging one of the truncated corners of the body of the first pivot arm.

12. The end pivot webguide of claim 11 wherein the actuator is electrically actuated.

13. The end pivot webguide of claim 8 wherein the means for rotatably mounting the guide roll to the roller frame comprises, in combination: a screw removably and nonrotatably secured to the roller frame; and bearing means rotatably mounting the guide roll on the screw.

14. The end pivot webguide of claim 13 wherein the first and second roller frames are L-shaped and include first and second flanges connected generally perpendicular to each other by their end edges.

15. The end pivot webguide of claim 14 wherein the first and second roller frames are formed of angle stock.

16. The end pivot webguide of claim 1 wherein the means for rotatably mounting the guide roll to the roller frame comprises, in combination: a screw removably and nonrotatably secured to the roller frame; and bearing means rotatably mounting the guide roll on the screw.

17. The end pivot webguide of claim 16 wherein the first and second roller frames are L-shaped and include first and second flanges connected generally perpendicular to each other by their end edges.

18. The end pivot webguide of claim 17 wherein the first and second roller frames are formed of angle stock.

19. The end pivot webguide of claim 1 wherein the means for pivotally mounting the first and second pivot pins in the body comprises, in combination: radial ball bearings having outer races mounted in the body and inner races mounted on the pivot pins.

20. The end pivot webguide of claim 19 further comprising, in combination: first and second passages formed in the body, with the passages including annular shoulders formed adjacent the top and the bottom of the body for abutting with the outer races of the radial ball bearings for preventing axial movement of the outer races of the radial ball bearings inwardly of the passage.

* * * * *